US009393536B2

(12) United States Patent
Boboltz et al.

(10) Patent No.: US 9,393,536 B2
(45) Date of Patent: Jul. 19, 2016

(54) PAINT DISPENSING APPARATUS

(71) Applicant: Dedoes Industries, Inc., Walled Lake, MI (US)

(72) Inventors: Scott Boboltz, New Hudson, MI (US); Scott A. Albright, Buchanan, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 89 days.

(21) Appl. No.: 14/548,761

(22) Filed: Nov. 20, 2014

(65) Prior Publication Data

US 2016/0144326 A1 May 26, 2016

(51) Int. Cl.

| | |
|---|---|
| ***B67D 7/78*** | (2010.01) |
| ***B01F 15/02*** | (2006.01) |
| ***B01F 3/12*** | (2006.01) |

(52) U.S. Cl.

CPC ..... *B01F 15/0278* (2013.01); *B01F 3/12* (2013.01); *B01F 2215/005* (2013.01)

(58) Field of Classification Search

CPC ... B01F 15/0278; B01F 3/12; B01F 2215/005
USPC ..... 222/144
See application file for complete search history.

(56) References Cited

U.S. PATENT DOCUMENTS

| | | | | |
|---|---|---|---|---|
| 6,206,250 | B1 | 3/2001 | Boers | |
| 6,230,938 | B1 * | 5/2001 | Boers | B01F 7/1695 215/322 |
| 6,474,516 | B2 | 11/2002 | Boers | |
| 6,755,326 | B2 | 6/2004 | Boers | |
| 8,813,793 | B2 | 8/2014 | Boboltz | |
| 2005/0087545 | A1 * | 4/2005 | Petrus Engels | B01F 13/1058 222/1 |
| 2005/0269367 | A1 | 12/2005 | Post | |
| 2006/0169718 | A1 * | 8/2006 | Buining | B01F 13/1058 222/144 |
| 2012/0031926 | A1 * | 2/2012 | Bertoli | B01F 13/1058 222/144 |
| 2012/0145263 | A1 * | 6/2012 | Solera | B01F 13/1058 137/565.17 |
| 2012/0175383 | A1 * | 7/2012 | Engels | B01F 7/00216 222/135 |
| 2013/0032244 | A1 * | 2/2013 | Boboltz | B01F 15/0445 141/83 |
| 2014/0299626 | A1 * | 10/2014 | Solera | B01F 13/1058 222/108 |
| 2014/0346191 | A1 * | 11/2014 | Brule | B01F 13/1055 222/144 |

FOREIGN PATENT DOCUMENTS

| | | |
|---|---|---|
| EP | 0800858 | 10/1997 |
| KR | 20-1997-0001652 | 3/1997 |
| WO | 9421554 | 9/1994 |

* cited by examiner

*Primary Examiner* — Patrick M Buechner
*Assistant Examiner* — Jeremy W Carroll
(74) *Attorney, Agent, or Firm* — Dinsmore & Shohl LLP

(57) ABSTRACT

A paint dispensing apparatus having a housing with a turntable rotatably mounted to the housing about a vertical axis. A plurality of stations on the turntable are circumferentially spaced from each other and each station is adapted to receive a paint dispenser having a plunger in which movement of the plunger dispenses paint from the paint dispenser. An indexing drive, upon activation, rotates the turntable to sequentially position the stations at a dispensing position. When at the dispensing position, an actuator mounted to the housing mechanically engages the plunger of the paint dispenser positioned at the dispensing station. A receptacle is mounted to the housing beneath the turntable and aligned with the dispensing position. A controller is then coupled to the indexing drive and is programmed to sequentially move the stations into alignment with the dispensing station and, when at the dispensing station, move the actuator to dispense paint from the paint dispenser at the dispensing position into the receptacle.

9 Claims, 5 Drawing Sheets

PAINT DISPENSING APPARATUS

BACKGROUND OF THE INVENTION

I. Field of the Invention

The present invention relates generally to a paint dispensing apparatus.

II. Description of Related Art

Paint is available in many, many variations of color, shade, brightness, etc. Indeed, there are so many variations of available paint color that it would be completely impractical, if not altogether impossible, for vendors of paint to store each and every color variation in inventory.

Consequently, in order to accommodate the many different variations in color, shade, etc. of paint, it has been the common practice to dispense two or more different colors of paint in varying amounts in order to achieve the final desired paint color. For example, in automotive repair shops it is oftentimes necessary to dispense different paint colors and then mix them together in order to match the paint on an existing vehicle that has been repaired. In order to obtain the desired paint color, it has been the previously known practice to utilize specifications provided by the automotive manufacturer of the required paint colors and then to manually dispense the paint together in a container in accordance with the manufacturer's paint formula. The manual dispensing of paint colors in the automotive repair shop, however, has a number of inherent disadvantages.

First, since the different colors of paint are dispensed together manually, there always exists the possibility of obtaining an incorrect paint mixture due to human error. While minor errors in the paint mixing process may be almost visually imperceptible, larger errors in the paint colors result in a final paint color for the paint that is clearly different than desired. When this occurs, it may be necessary to repaint the vehicle.

A still further disadvantage of this previously known process of manually dispensing the paint colors together in an automotive repair shop is that the dispensing process is labor intensive and, therefore, expensive in labor costs.

SUMMARY OF THE PRESENT INVENTION

The present invention provides an apparatus for dispensing paints that overcomes the above mentioned disadvantages of the previously known paint dispensing methods.

In brief, the present invention provides a paint dispensing apparatus having a housing and a turntable rotatably mounted to the housing about a vertical axis. A plurality of stations are formed on the turntable and these stations are circumferentially spaced from each other.

Each station is adapted to receive a paint dispenser having a lid to a paint container and in which the lid for the paint dispenser has a plunger. Movement of the plunger dispenses paint from the paint dispenser in an amount corresponding to the amount of movement of the plunger. Similarly, the lid for the dispenser includes a flow valve which controls the direction of paint flow between the plunger and either the paint container or dispensing the paint.

An indexing drive is mounted on the housing which, upon activation, rotates a turntable to sequentially position the turntable stations at a dispensing position on the housing. An actuator is mounted to the housing which mechanically engages the plunger of the paint dispenser when it is positioned at the dispensing position. This actuator, furthermore, is movable to displace the plunger and dispense paint from the paint dispenser. A valve actuator also engages the flow valve of the paint dispenser at the dispensing position.

A receptacle is supported by the housing beneath the turntable and aligned with the dispensing position. The receptacle is open to the paint dispenser at the paint dispensing position through openings in both the turntable and housing so that any paint dispensed from the paint dispenser will collect in the receptacle.

A controller then is coupled to the indexing drive and the actuator. This controller is programmed to sequentially move the stations into alignment with the dispensing position and, when at the dispensing position, control the flow valve and displace the actuator in a controlled amount to dispense the desired amount of paint from the dispenser into the receptacle in order to achieve the desired final color. An electronic scale beneath the receptacle provides an output signal to the controller to monitor the precise amount of paint in the receptacle.

In practice, the paint dispenser comprises a lid which is attached to the open top of a paint container. Furthermore, the paint container is preferably water based and of the type directly sold by the paint manufacturer. As such, there is no necessity for the operator of the paint mixing apparatus to transfer paint from the paint container received from the manufacturer to a separate or different container used by the paint dispensing apparatus. Furthermore, since the entire operation of the paint dispensing apparatus is automatic after the proper paint colors are loaded onto the stations on the turntable, only minimal labor costs are required in order to complete the paint dispensing operation.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
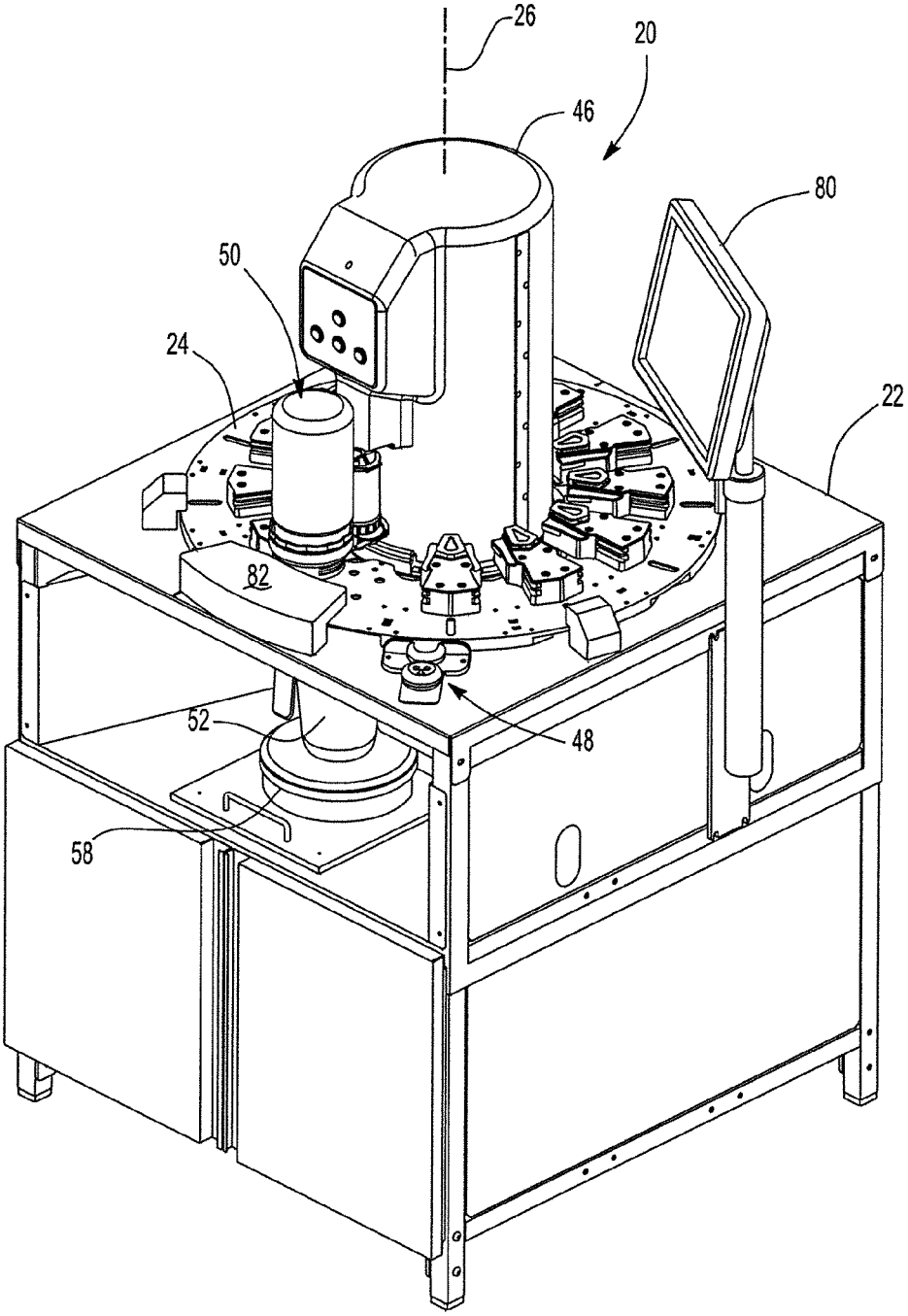
FIG. 1 is an elevational view illustrating a preferred embodiment of the present invention.
Figure 2:
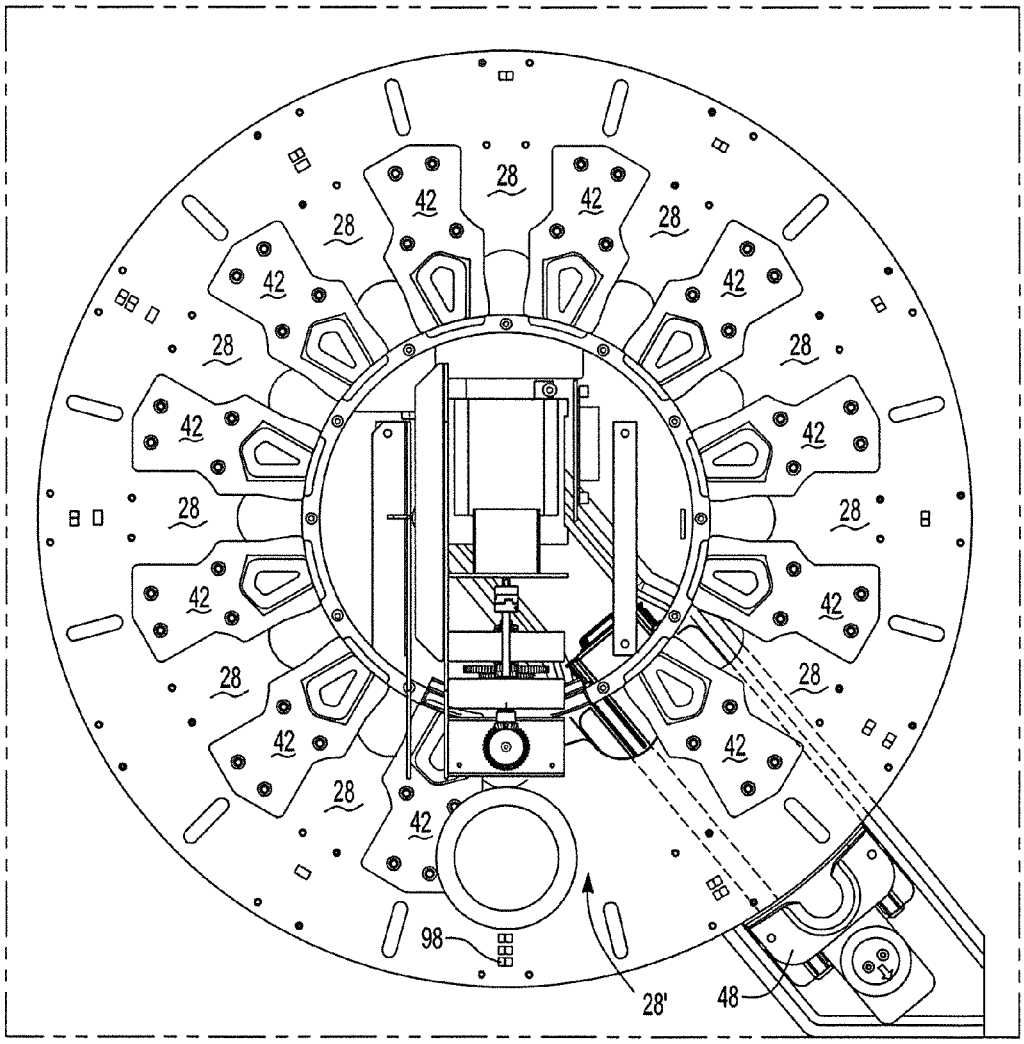
FIG. 2 is a top view illustrating the turntable and with parts removed for clarity.
Figure 3:
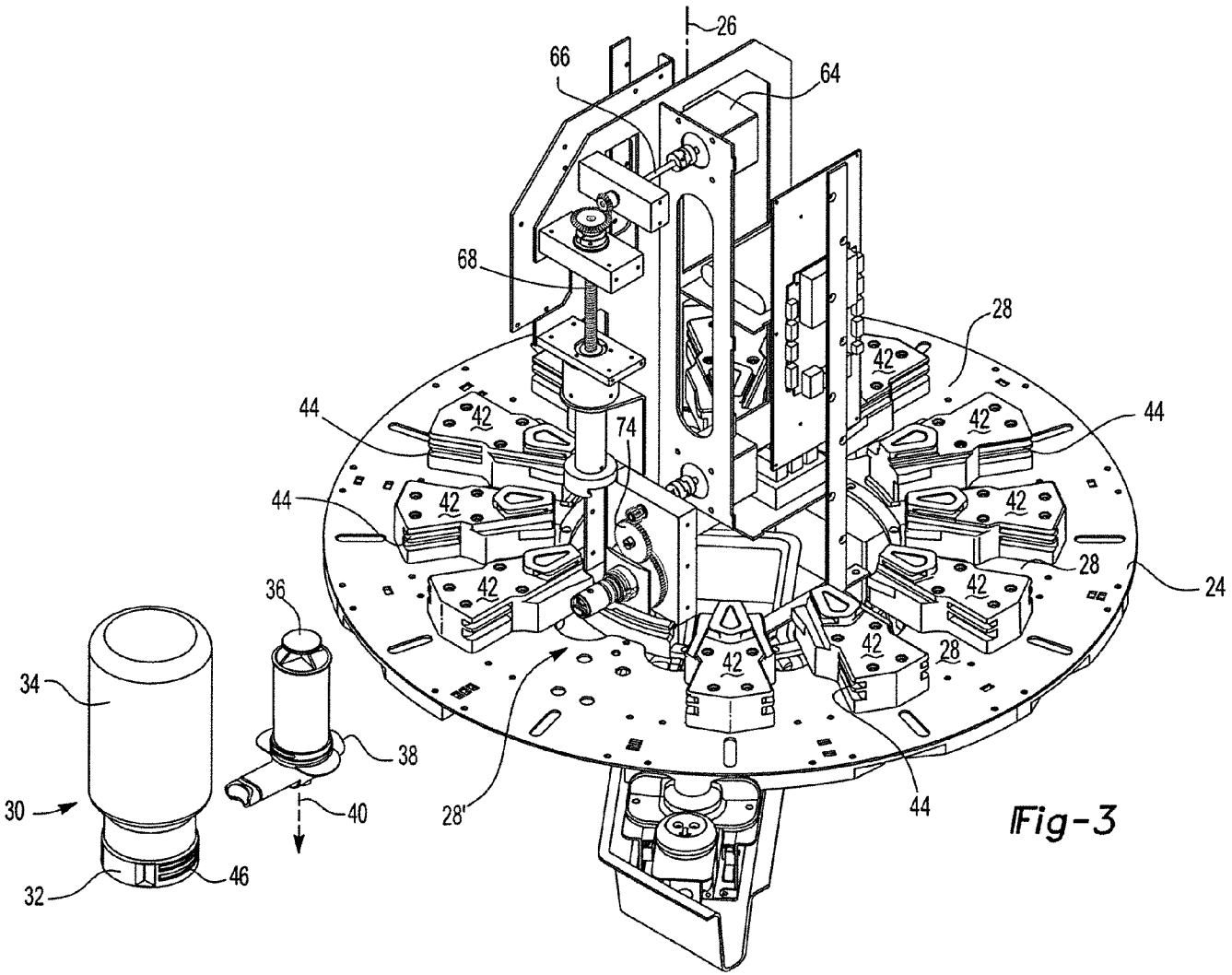
FIG. 3 is an exploded elevational view of the turntable and associated components and with parts removed for clarity.

With reference first to FIGS. 1-3, a paint mixing apparatus 20 according to the present invention is shown and includes a housing 22. An annular and generally planar turntable 24 is rotatably mounted to the housing 22 about a vertical axis 26. Any conventional mechanism, such as rollers (FIG. 4), may be used to rotatably mount the turntable 24 to the housing 22.

Referring still to FIGS. 1-3, the turntable 24 includes a plurality of stations 28 that are equidistantly circumferentially spaced from each other around the vertical axis 26 on the turntable 24. As shown in the drawing, there are twelve different stations 28 around the turntable 24. However, fewer or more stations 28 may be provided without deviation from either the spirit or scope of the present invention.

As best shown in FIGS. 1 and 3, each station 28 is designed to removably receive one paint dispenser 30. Furthermore, each paint dispenser 30 includes a dispensing lid 32 which is secured to an open top of a paint container 34 of the type sold directly by a paint manufacturer. Thus, in order to form the paint dispenser 30, it is only necessary to remove the cap provided by the paint manufacturer and to replace the cap with the dispensing lid 32.

As best shown in FIG. 3, the dispensing lid 32 includes a plunger 36 as well as a flow valve 38. Depending upon the position of the valve 38, displacement of the plunger 36 will either draw paint from the paint container 34 into the plunger 36 or, alternatively, dispense paint from the plunger 36 downwardly from the bottom of the plunger as illustrated diagrammatically at 40 in FIG. 3.

Although different types of dispensing lids 32 may be used, in the preferred embodiment of the invention, a dispensing lid in accordance with that described in U.S. Pat. No. 8,813,793, entitled "Paint Formulation and Dispensing Apparatus" and issued on Aug. 26, 2014, is used in conjunction with the paint dispensing apparatus of the present invention. The entire disclosure from said U.S. Pat. No. 8,813,793 is incorporated herein.

With reference now to FIGS. 1 and 3, a guide block 42 is provided along each side of each station 28 on the turntable 24. (One guide block 42 at station 28' is removed for clarity.) These guide blocks include guiderails 44 (FIG. 3) which mechanically cooperate with guide slots 46 formed in the dispensing lid 32 to guide the paint dispenser 30 from a removed position, as shown in FIG. 3, and to an installed position, shown in FIG. 1, in which the guide blocks 42 engage and support the dispensing lid 32 in a dispensing position. In the dispensing position, the paint container 34 is inverted, i.e. its open top faces downwardly, and the plunger 36 is positioned adjacent a cylindrical hub 46 mounted to the housing 22 and around which the turntable 24 rotates.

Figure 6:
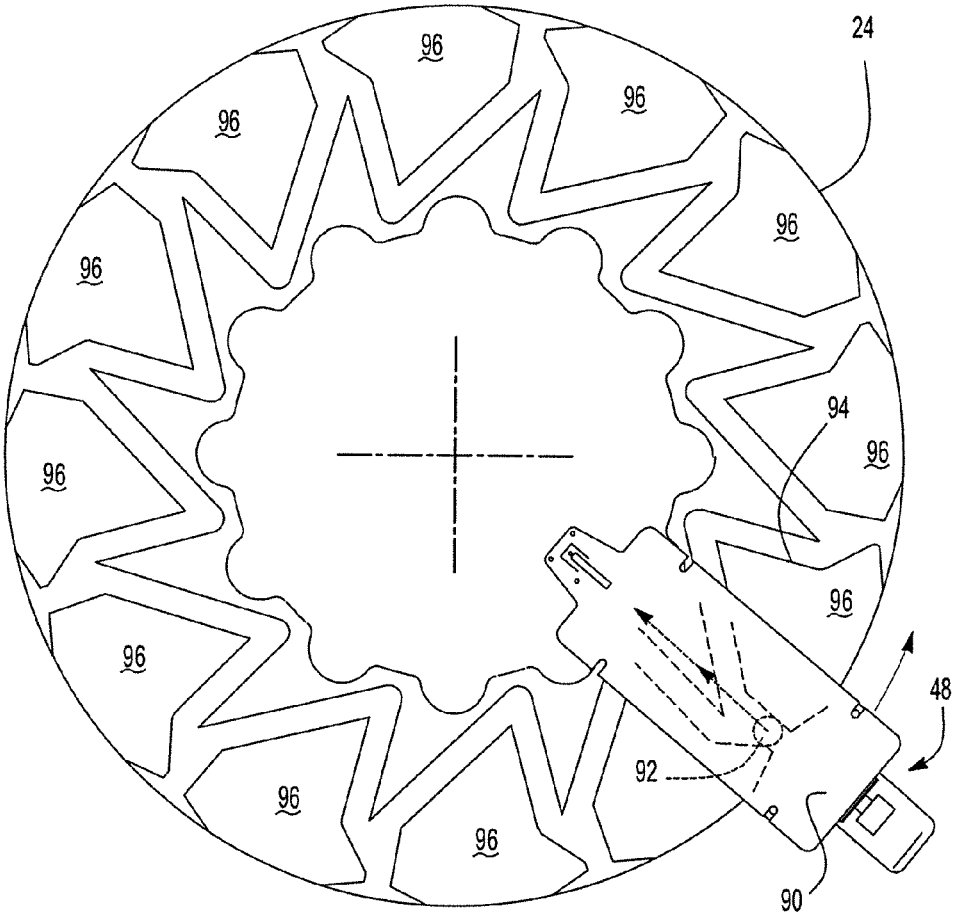
FIG. 6 is a view of the indexing drive.

With reference now to FIGS. 1, 2, and 6, with two or more paint dispensers 30 mounted to adjacent stations 28 on the turntable 24, an indexing motor 48 under control of a control unit 51 rotatably indexes the table 24 to sequentially move the paint dispensers 30 to a dispensing position 50. In the dispensing position 50, the plunger 36 for the paint dispenser 30 is aligned with an opening 52 formed in the housing 22 and also aligned with an opening 54 which is formed through the turntable at each station 28. Consequently, any paint that is dispensed from the paint dispenser 30 as shown by arrow 40 passes through the turntable opening 54 as well as the opening 52 in the housing 22.

With reference now particularly to FIG. 6, although any type of indexing drive 48 may be used to rotate the turntable 24, preferably the indexing drive includes pneumatic piston 90 having an end 92 slidably mounted in a track 94 on the bottom of the turntable 24. The track includes a plurality of V-shaped sections 96 corresponding in number to the number of stations 28. Consequently, one reciprocation of the end 92 of the piston 90 rotatably drives the turntable an angular amount corresponding to the circumferential spacing of the stations.

In addition and as best shown in FIG. 2, binary encoded through slots 98 are associated with each station 28 on the turntable 24 so that each binary code is unique for each station. Consequently, by sensing light using, for example fiber optics, the control unit 51 can unambiguously identify the number of the station which is aligned with the dispensing position 50.

A paint receptacle 56 is also aligned with the housing opening so that any paint dispensed from the paint dispenser 30 is collected within the container 52. This container 52 is supported by an electronic scale 58 on the housing 22. The scale 58 provides an electrical signal back to the control unit 51 (FIG. 4) indicative of the overall weight of the paint contained within the paint container 52 and thus indicative of the amount of paint in the container 52. As will be subsequently described, that weight signal then corresponds to the amount of paint that is dispensed into the container 52.

Figure 4:
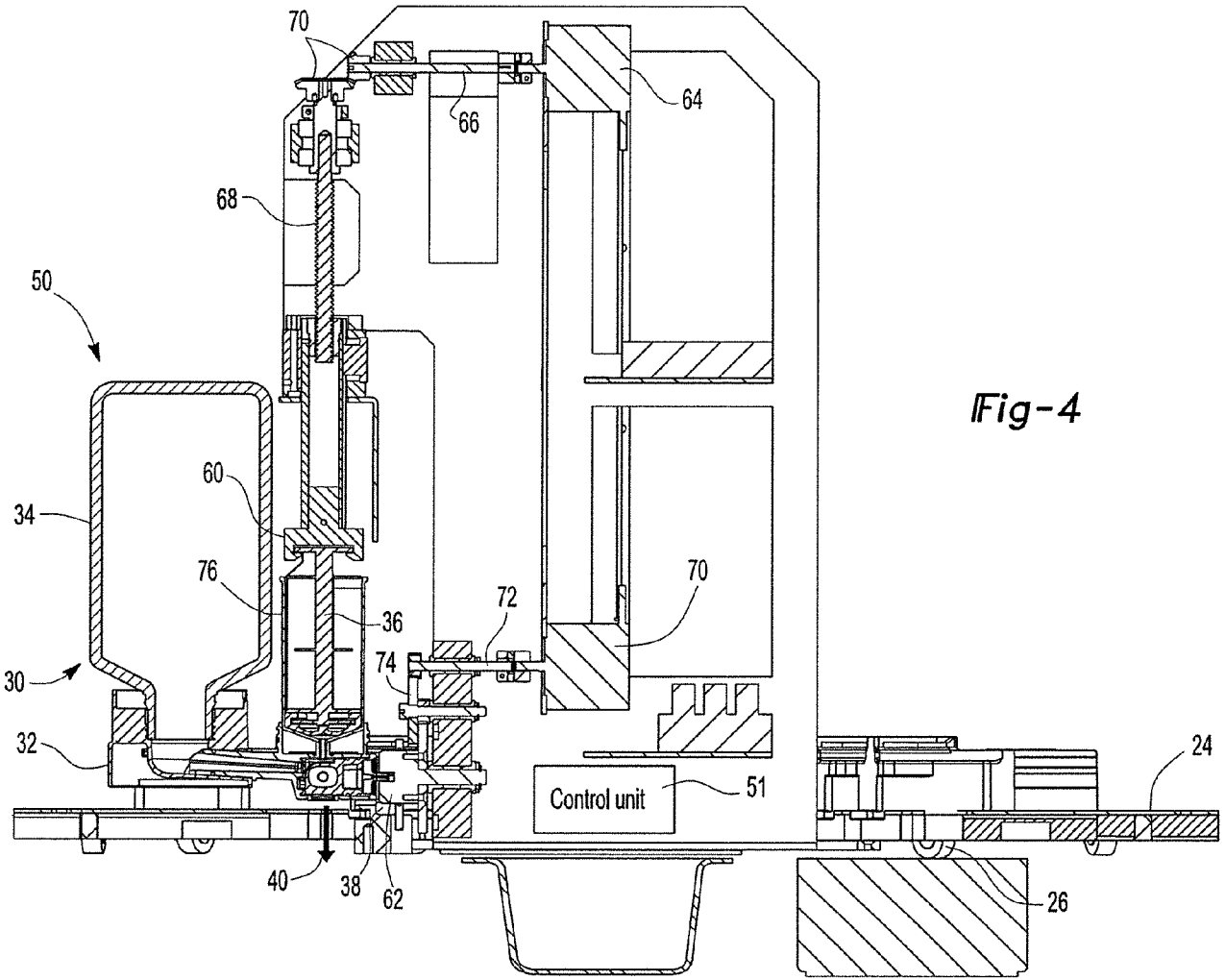
FIG. 4 is a side partial sectional view illustrating a preferred embodiment of the present invention and with parts removed for clarity.

With reference now to FIG. 4, when the paint dispenser 30 is positioned at the dispensing position 50 a plunger actuator 60 engages the plunger 36 so that vertical movement of the plunger actuator 60 simultaneously vertically displaces the plunger 36. Similarly, a valve actuator 62 engages the flow valve 38 on the dispensing lid 32 when the paint dispenser 30 is in the dispensing position. Consequently, rotation of the valve actuator 62 rotatably drives the valve 38.

A controllable motor 64 vertically controls the position of the plunger actuator 60 through a driveshaft 66, threaded shaft 68, and bevel gears. Consequently, under control by the control unit 51, the actuation of the motor 64 rotatably drives the threaded shaft 68 in either rotational direction in order to vertically displace the actuator 60, with its attached plunger, upwardly or downwardly. Similarly, a second motor 70, under control of the control unit 51, rotatably drives shaft 72 and a pinion 74 in order to rotatably position the valve actuator 62.

Figure 5:
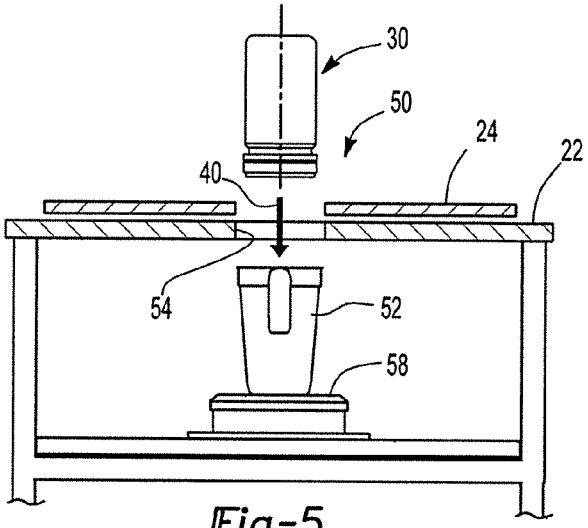
FIG. 5 is a front view illustrating the dispensing position of the mixing apparatus.

As described more fully in U.S. Pat. No. 8,813,793, the position of the valve 38 on the dispensing lid 32 controls whether or not the displacement of paint contained within the cylinder 76 containing the plunger 36 displaces paint back into the container 34 or downwardly from the dispensing lid 32 as shown by arrow 40 into the container 52 (FIG. 5). The actual amount of vertical displacement of the plunger 36 within its cylinder 76 controls the amount of paint displaced by the movement of the plunger 36.

With reference now to FIG. 1, in operation the control unit 50 (FIG. 4) receives the paint formula for the desired paint color in any fashion, such as from a computer having access to the paint formulae. Each formula, furthermore, contains the amount and different colors of paint to dispense in order to achieve the desired end color. These formulas, or at least the necessary different colors of paints and their order, are preferably displayed on a display screen 80 for a user of the apparatus 20.

The operator then loads the required different colors of paint in sequential stations 28 around the turntable 24 in the order displayed on the display 80. When all the paints have been properly loaded into the stations 28 on the turntable 24, the operator initiates the paint dispensing operation by the appropriate selection on the display 80, which is preferably a touch screen.

Upon activation, the control unit moves the first paint dispenser 30 containing the first paint to the dispensing position 50. A bumper 82 (FIG. 1) also preferably engages the paint lid 32 to ensure that the entire paint dispenser 30 is positioned at its proper radially inwardmost position.

With the first color of paint positioned at the dispensing position 50, the control unit then actuates the motors 64 and 70 to control not only the flow of paint from the paint container 34, but also the amount of paint dispensed by the plunger into the container 52. The electronic scale 58 provides a weight signal back to the control unit 50 which is utilized to determine the total amount of paint in the container 52 and thus whether or not the proper amount of paint has been dispensed into the container 52. When the proper amount of paint from the paint dispenser 30 at the dispensing position has been obtained, the actuator 60 (FIG. 4) and valve actuator 62 are returned to their initial positions.

The indexing motor 48 then indexes the table 28 and aligns the next sequential paint dispenser 30 at the dispensing position 50. The control unit 50 then actuates the motors 64 and 70 to control the movement of both the valve 38 and plunger 36 to dispense the proper amount of paint into the container 52. Again, the electronic scale 58 provides a signal of the total amount of weight of the paint back to the control unit 50 to enable the control unit 50 to determine when the proper amount of paint has been dispensed into the container 52. When completed, the plunger actuator 60 and valve actuator 62 are returned to their initial position. Thereafter, the above process is repeated until all of the paints contained at the turntable stations 28 have been aligned with the dispensing position 50 in the proper amount in order to obtain the desired end color of the paint.

A primary advantage of Applicant's invention is that the entire paint mixing apparatus only requires the operator intervention in loading the proper colors of paint within the turntable stations 28 prior to the initiation of the paint mixing operation. Once the proper colors of paint have been loaded into the stations 28, the entire paint dispensing operation is completely automatic.

A further advantage of Applicant's invention over the previously known methods is that the paint dispenser 30 utilizes the paint containers 34, typically water based, which are provided directly from the manufacturer. Consequently, all intermediate handling of the paint from the paint containers is avoided.

From the foregoing, it can be seen that the present invention provides a paint dispensing apparatus which is simple and accurate in use. Having described our invention, however, many modifications thereto will become apparent to those skilled in the art to which it pertains without deviation from the spirit of the invention as defined by the scope of the appended claims.

We claim:

1. A paint dispensing apparatus comprising:

a housing, a turntable rotatably mounted to said housing about a vertical axis, a plurality of stations on said turntable, said stations being circumferentially spaced from each other, each station adapted to receive a paint dispenser having a plunger wherein movement of said plunger dispenses paint from the paint dispenser, an indexing drive which, upon activation, rotates said turntable to sequentially position said stations at a dispensing position, an actuator mounted to said housing which mechanically engages the plunger of the paint dispenser positioned at said dispensing station, a receptacle supported by said housing beneath the turntable and aligned with said dispensing position, a controller coupled to said indexing drive and said actuator, said controller being programmed to sequentially move said stations into alignment with said dispensing position and, when at said dispensing position, move said actuator to dispense paint from the paint dispenser at said dispensing position into said receptacle, wherein said indexing drive comprises a track on the bottom of said turntable, said track comprising a plurality of circumferentially adjacent V-shaped segments, and a piston and cylinder, said piston having a free end slidably mounted in said track.

2. The apparatus as defined in claim 1 wherein each paint dispenser comprises a container having an open top and a lid secured to said open top of said container, said plunger being mounted on said lid.

3. The apparatus as defined in claim 1 wherein each station includes at least one slide rail which cooperates with a slide on the paint dispenser to slidably receive and position the paint dispenser into said station.

4. The apparatus as defined in claim 1 and comprising a scale positioned under said receptacle, said scale having an output signal connected as an input to said controller.

5. The apparatus as defined in claim 1 and comprising a bumper attached to said housing which engages and urges the paint dispenser radially inwardly when at the dispensing position.

6. The apparatus as defined in claim 5 wherein said bumper is aligned with said dispensing station.

7. The apparatus as defined in claim 1 wherein said controller comprises a processor having access to paint formulae for a plurality of different colors of paint.

8. The apparatus as defined in claim 1 wherein each paint dispenser is radially slidably received in its associated station.

9. The apparatus as defined in claim 1 wherein said piston reciprocates in a radial direction relative to the axis of said turntable.

* * * * *